US009840811B2

(12) United States Patent
Müller et al.

(10) Patent No.: US 9,840,811 B2
(45) Date of Patent: Dec. 12, 2017

(54) PACKAGING MATERIAL COMPRISING A STARCH-BASED BARRIER COATING AND COATING COMPOSITION AND PROCESS FOR PRODUCING THE SAME

(71) Applicant: INNOGEL AG, Hünenberg (CH)

(72) Inventors: Rolf Müller, Zürich (CH); Federico Innerebner, Zürich (CH)

(73) Assignee: Innogel AG, Hunenberg (CH)

( * ) Notice: Subject to any disclaimer, the term of this patent is extended or adjusted under 35 U.S.C. 154(b) by 0 days.

(21) Appl. No.: 15/022,223

(22) PCT Filed: Sep. 18, 2014

(86) PCT No.: PCT/EP2014/069939
§ 371 (c)(1),
(2) Date: Mar. 16, 2016

(87) PCT Pub. No.: WO2015/040134
PCT Pub. Date: Mar. 26, 2015

(65) Prior Publication Data

US 2016/0230342 A1 Aug. 11, 2016

(30) Foreign Application Priority Data

Sep. 18, 2013 (CH) ..... 1602/13

(51) Int. Cl.

| | |
|---|---|
| ***D21H 19/54*** | (2006.01) |
| ***D21H 27/10*** | (2006.01) |
| ***D21H 17/28*** | (2006.01) |
| ***D21H 19/12*** | (2006.01) |
| ***D21H 21/16*** | (2006.01) |
| ***D21H 21/14*** | (2006.01) |

(52) U.S. Cl.
CPC ..... *D21H 19/54* (2013.01); *D21H 17/28* (2013.01); *D21H 19/12* (2013.01); *D21H 21/14* (2013.01); *D21H 21/16* (2013.01); *D21H 27/10* (2013.01)

(58) Field of Classification Search
CPC ..... D21H 19/54; D21H 17/28; D21H 19/12; D21H 21/14; D21H 21/16; D21H 27/10
USPC ..... 428/533
See application file for complete search history.

(56) References Cited

U.S. PATENT DOCUMENTS

| | | | | |
|---|---|---|---|---|
| 2007/0102130 | A1* | 5/2007 | Satyavolu | C08L 3/00 162/179 |
| 2009/0107360 | A1* | 4/2009 | Anderson | C08B 31/003 106/162.9 |

FOREIGN PATENT DOCUMENTS

| | | | |
|---|---|---|---|
| EP | 0690170 | * | 1/1996 |
| EP | 0690170 | A1 | 1/1996 |
| GB | 591370 | * | 8/1947 |
| GB | 591370 | A | 8/1947 |
| WO | WO03/021039 | * | 3/2003 |
| WO | WO03021039 | A1 | 3/2003 |
| WO | WO2013/041561 | * | 3/2013 |
| WO | WO2013041561 | A1 | 3/2013 |
| WO | WO2013/076241 | * | 5/2013 |
| WO | WO2013076241 | A2 | 5/2013 |

OTHER PUBLICATIONS

International Search Report and Written Opinion dated Feb. 3, 2015 in International Patent Application No. PCT/EP2014/069939.

* cited by examiner

*Primary Examiner* — Leszek Kiliman
(74) *Attorney, Agent, or Firm* — William H. Honaker; Dickinson Wright PLLC

(57) ABSTRACT

A starch-based coating compound for packaging materials, in particular for paper, pasteboard or cardboard, wherein the starch has a molecular weight in the range of 800,000 to 50,000,000 g/mol, preferably in the range of 800,000 to 20,000,000 g/mol. The coating compound is used for surface-sealing packaging materials, to prevent the passage of mineral oil contaminants from the packaging material into packaged goods. The subject disclosure furthermore relates to a multi-layer packaging material, which is produced using the coating compound, and to a method for producing said packaging material.

18 Claims, 1 Drawing Sheet

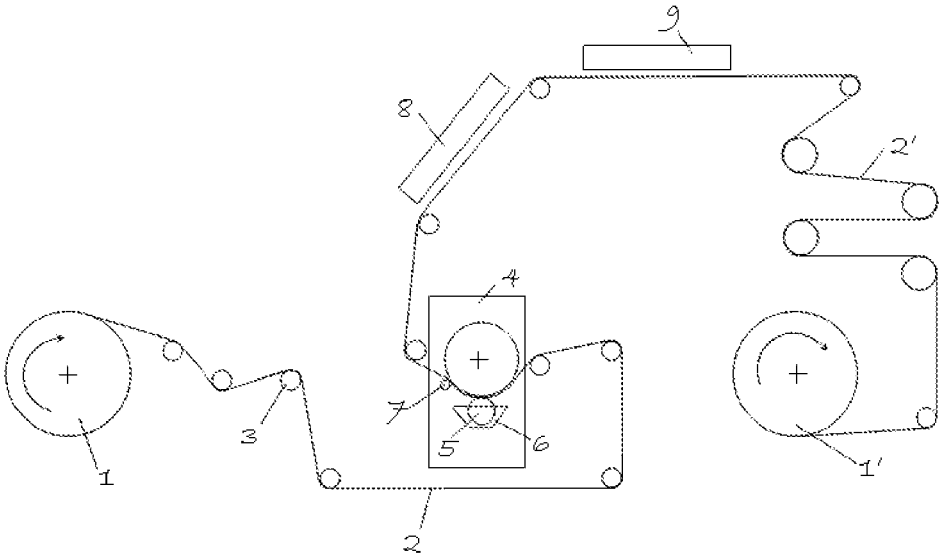
9
8
2'
4
7
5
6
3
1
1'
2

PACKAGING MATERIAL COMPRISING A STARCH-BASED BARRIER COATING AND COATING COMPOSITION AND PROCESS FOR PRODUCING THE SAME

CROSS-REFERENCE TO RELATED APPLICATIONS

This application is a National Stage of International Application No. PCT/EP2014/069939, filed Sep. 18, 2014, which claims the benefit and priority of CH 01602/13 filed Sep. 18, 2013. The entire disclosures of each of the above applications are incorporated herein by reference.

TECHNICAL FIELD

The invention relates to a packaging material comprising a starch-based barrier coating, to a method for producing a packaging material comprising a starch-based barrier coating, to a starch-based coating compound, and to the use thereof for surface-sealing of packaging materials.

PRIOR ART

In 2009, the Cantonal Laboratory of Zürich pointed out the problem of the migration of mineral oils from cardboard packaging to so-called "dry" food in scientific publications. This problem arises in particular in the case of packaging made of recycling cardboard. The inks from the newspaper production, but also the inks for printing the cardboard packaging, were identified as main sources for the mineral oil contamination. However, due to the fact that the migration occurs mainly via the gas phase, it cannot be ruled out that mineral oil residues from secondary packaging or from adjacent packaging reaches into the food when using virgin fiber-based cardboard as well.

119 samples of dry food from various packaging types were examined with regard to their mineral oil content (mineral oil saturated hydrocarbons (MOSH)) in a publication by A. Vollmer et al. from the year 2011 (Eur Food Res Technol (2011) 232:175-182). In addition to these saturated aliphatic and cyclic hydrocarbons (MOSH), the aromatic hydrocarbons (mineral oil aromatic hydrocarbons (MOAN)) in the form of mixtures of predominantly alkylated aromatic hydrocarbons play an important role as relevant contaminants. Food without additional repackaging absorb up to 70% of the MOSH and a large portion of the MOAH from the packaging via the gas phase (migration). The mineral oil contaminants thus far exceed the maximum permitted levels. According to this study, additional inner packaging made of paper or polyethylene (PE) was not able to limit the mineral oil migration. However, the authors came to the conclusion that inner packaging made of polypropylene (PE), acrylate-coated PE, polyethylene terephthalate (PET) or films comprising an aluminum coating effectively prevented the MOSH migration into the dry food at least for a period of 3 months.

In its Opinion No. 008/2010 of Dec. 9, 2009, the German Federal Institute for Risk Assessment (Deutsches Bundesinstitut für Risikobewertung (BfR)) came to similar conclusions. The elimination of direct contact of recycling paper and cardboard with dry food comprising a large specific surface by using inner bags (e.g. PET films) comprising a barrier effect are proposed as short-term courses of action in the publication, which can be obtained under http://www.b-fr.bund.de/de/fragen und antworten zu mineraloel uebergaengen aus verpackungsmaterialien auf lebensmittel-50470.html.

Such additional inner packaging, however, are not desired for economic reasons on the one hand, because it increases the price of the packaging, and, on the other hand, because it is non-environmental, because it increases the volume of waste.

The paper industry thus attempts to use further approaches to deal with the problem of the mineral oil contamination in the packaging sector. On the one hand, attempts are made to eliminate the sources for the contamination, in that fresh cardboard material and mineral oil-free inks are used. The contaminations can be prevented in this way. Foregoing the use of recycling paper, however, is extremely disadvantageous from an environmental and economic aspect.

Cleaning the old paper prior to producing the cardboard would also be a suitable way to prevent the mineral oil contamination of the food. To adhere to the migration limits, it will most likely be necessary to remove up to 99% of the mineral oil from the old paper. However, the suitable large-scale methods for this still do not exist and it is furthermore already foreseeable that this is an extremely cost- and resource-intensive approach.

Further approaches lie in the use of multi-layer laminates and in the application of barrier layers to the inside of cardboard packaging so as to eliminate the migration of the mineral oil contamination via the gas phase. It gives manufacturers of paper and cardboard packaging, in particular of folding cartonboard and corrugated cardboard liners the opportunity to quickly react to the existing demand for new packaging solutions, without having to forego the use of recycling paper, which is extremely worthwhile ecologically.

It is proposed in WO13076241A2 to use aqueous polyvinyl acetate-based dispersions to produce a coating on film-shaped substrates to reduce the diffusion of oil-containing substances from packaging in food and medical products.

However, the polyvinyl acetate-based barrier layer is not soluble in water and thus interferes with the recycling of a cardboard, which is treated in this manner, in recycling processes, as they are currently common. In addition, the use of a synthetic coating, which has a poor biodegradability, tarnishes the look of the cardboard packaging as a packaging solution, which is extremely worthwhile ecologically. Due to the fact that such coatings are also comparatively expensive, there is still a need for cost-efficient ecologically worthwhile coating means comprising a good barrier effect.

Starch-based coatings are known in the paper industry. They are used, for example, in the paper surface treatment in coating colors to provide an increased stability to cardboard, or to improve the paper characteristics, such as, e.g., to reduce dust and smoothing surfaces, for a better printability.

When being cooked in solution, starch already develops a high viscosity in the case of small portions of solids. For example, a 10% starch solution can have a viscosity of >5,000 mPas at 40° C. and is thus unusable in common coating processes. On principle, partially degraded starches comprising average molecular weights of $M_w$<<1,000,000 g/mol are used so as to keep the viscosity of the starch solution and thus of the coating compound within manageable limits (for example a 50% starch solution comprising a viscosity of <3,000 mPas at 40° C.), in the case of higher portions of solids.

Starch coatings from such degraded or partially degraded starches are relatively brittle and break easily in response to the production of the cardboard packaging. Such coatings do not withstand in particular the mechanical stresses in response to folding and creasing of the cardboard packaging, so that undesired surface defects are created in the coating, through which, in turn, mineral oil residues can migrate into the packaged food. Such compositions are unusable as barrier coating.

The demands on the mechanical characteristics and on the barrier effect of the coating thus conflict with the demands by the coating process. At present, this problem has not yet been solved satisfactorily.

It is thus an object of the invention to provide improved compositions for the coating of packaging materials, which can be used in an economically worthwhile manner, which can be applied to planar/extensive/flat/sheet substrates in an efficient and cost-effective manner, and which thereby simultaneously have an excellent barrier characteristic.

DISCLOSURE OF THE INVENTION

The object is solved by means of the features of the independent claims. Preferred embodiments are reflected in the dependent claims.

According to a first aspect, the present invention relates to a multi-layer packaging material, comprising a planar/extensive/flat/sheet substrate and at least one starch-based barrier layer applied thereto.

A further aspect of the invention relates to a method for producing this packaging material.

The invention furthermore relates to a coating compound, which is suitable to produce the packaging material according to the invention, and the use of which is preferred for the production of the packaging material.

The invention further relates to the use of a starch-based coating compound for surface-sealing of packaging materials, to prevent or to reduce the migration of lipophilic contaminants, which are contained in the packaging material, for example, into the packaged good. The use of coating compounds according to the invention is preferred for this.

Lipophilic contaminants in terms of the present invention comprise mineral oil contaminants, which originate from residues of printing inks in recycled paper, for example. The contaminants comprise linear, cycled and aromatic hydrocarbons, in particular MOSH and/or MOAH.

As natural polymer from re-growing raw material sources, starch has the crucial advantage that the price is low and that the environmental balance is positive as compared to the synthetic products. A further advantage is that starch has already established itself in the paper industry and does not represent an interference factor in the existing recycling processes.

According to the present invention, a coating compound in the form of a solution comprising long-chained, thus highly molecular starch molecules, is used, which can be applied efficiently with a high solids content to a suitable substrate or to a carrier layer, respectively, of a packaging material, preferably to paper, pasteboard or cardboard, and which is subsequently formed into a film on the substrate to form a cohesive barrier layer or a cohesive barrier film, respectively. This barrier layer limits the migration of lipophilic contaminants from the packaging or through the packaging into the packaged product significantly or prevents this entirely. Surprisingly, it turned out that long-chained starch types can be used in a worthwhile manner for coating and that the use of long-chained starch types in the barrier coating furthermore leads to significantly improved mechanical characteristics and barrier characteristics of the coating.

The coating compound according to the invention is used as solution, preferably as aqueous solution, the solids content of which includes starch as main component. The barrier effect is significantly dependent on the fact that a barrier coating, which is virtually free from surface defects (e.g. pinholes), is obtained across the entire surface, and that the barrier coating is flexible and not sticky thereby, so that the multi-layer packaging material obtained in this manner, for example the coated paper, can be treated by means of the creasing and folding techniques, which are common in the packaging industry, without the barrier coating being damaged or impacted in a noteworthy manner thereby. This is the only way to ensure that the packaged good, for example the packaged food, is/are also protected sufficiently against the above-mentioned contaminants to enter, even in the case of longer storage periods.

The coating compound according to the invention is starch-based. The lower the molecular weight of the used starch, the more brittle the starch or the barrier film produced therefrom, respectively, even in the case of higher plasticizer contents. Brittle films are unusable as barrier, because they break easily or form tears, respectively, and thus make it possible for contaminants to pass. On the other hand, the viscosity of starch increases massively in solution with the molecular weight of the used starch. The viscosity in solution is dominated primarily by the largest starch macromolecules. However, to be able to economically apply the starch compound to a packaging material, for example a paper, a low viscosity of the compound, which is used for the coating, is desired. In the case of highly-molecular starches, the viscosity of the solution can be reached by using a low solids content, which correlates with a high water content of the solution. However, this water has to be dried off at high costs in response to the production of the packaging materials.

The approach according to the invention, in the case of which particularly advantageous compositions were developed for the coating of packaging materials, provides a way out of this situation.

Coating Compound

The coating compound according to the invention is obtained from a coating composition, which comprises the integral parts, which are cited below for the coating compound, wherein every starch comprising a molecular weight $M_w$ of at least or more than 0.8 million g/mol can be used for the at least one starch. The starch(es) as well as the optionally also comprised solid and/or liquid additives are typically stirred into an aqueous solution, preferably into water. The terms coating composition and coating compound differ in that the coating compound in terms of the present patent application refers to the composition, which can be used or which is used directly for coating, and in which the starch is already present in dissolved form.

Unless otherwise specified, the abbreviation $M_w$ always identifies the weight average of the molecular weight.

The starch-based coating compound according to the invention comprises

- at least one starch,
- 0-70% by weight of plasticizer,
- 0-50% by weight of a polymeric additive or of a plurality of polymeric additives,
- 0-5% by weight of an additive or of an additive mixture, and water.

Unless otherwise specified, it shall apply for the present patent application that all of the specified starch portions are based on the sum of the portions of starch plus plasticizer plus water. Accordingly, the plasticizer portions are based on the sum of starch plus plasticizer. The portion of the polymeric additive(s) is based on the sum of starch plus polymeric additive. The portion of the additive(s) is based on the dry mixture or composition, respectively.

The water portion is the remainder at 100% by weight, wherein a filler portion, if present, is not considered for the calculation.

In the ready-to-use, finished coating compound, the starch is present in dissolved form.

According to a possible embodiment of the present invention, the coating compound consists of the at least one starch, wherein the portion thereof, based on starch, plasticizer and water, is determined according to Table 1, which is explained below. 0-70% by weight of at least one plasticizer, 0-50% by weight of at least one polymeric additive, 0-5% by weight of at least one additive, and of a remainder of water to 100% by weight.

The lower limit for the molecular weight $M_w$ of the at least one starch in million g/mol (=$10^6$ g/mol=million g/mol) is 0.8, preferably 1.0, more preferably 1.5, more preferably 2.0, more preferably 2.25, more preferably 2.5, more preferably 2.75, most preferably 3.0.

The upper limit for the molecular weight $M_w$ of the at least one starch in million g/mol in the coating compound is approximately 20, preferably 15, more preferably 12, more preferably 10, more preferably 9, more preferably 8, more preferably 7, most preferably 6. In another embodiment, the upper limit for the molecular weight $M_w$ of the at least one starch can be more than 20 million g/mol, preferably in the range of more than 20 to 50 million g/mol.

The portion of the starch in% by weight in the coating compound, based on starch and plasticizer and water, depends on the molecular weight $M_w$ of the starch and is reflected by Table 1 below.

The lower limit of the portion of the starch in % by weight for the respective molecular weights is specified in Table 1 in line A1, a preferred lower limit is specified in line A2, a more preferred lower limit is specified in line A3, a more preferred lower limit is specified in line A4, a more preferred lower limit is specified in line A5, a more preferred lower limit is specified in line A6, a more preferred lower limit is specified in line A7, most preferred in line A8.

The upper limit of the portion of the starch in % by weight for the respective molecular weights is specified in Table 1 in line B1, a preferred upper limit is specified in line B2, a more preferred upper limit is specified in line B3, a more preferred upper limit is specified in line B4, a more preferred upper limit is specified in line B5, a more preferred upper limit is specified in line B6, a more preferred upper limit is specified in line B7, most preferred the upper limit is according to line B8.

The lower and upper limits for the portion of a starch in the case of a molecular weight, which lies between the values or outside of the values of Table 1, can be obtained by means of linear interpolation or by means of linear extrapolation. For starches comprising a molecular weight $M_w$ of more than 20 million g/mol, preferably in the range of more than 20 million g/mol to 50 million g/mol, the values can be obtained by means of linear extrapolation.

TABLE 1 starch portion in % by weight in dependence on $M_w$ in million g/mol

| | million g/mol | | | | | | | | | | | | | | | |
|---|---|---|---|---|---|---|---|---|---|---|---|---|---|---|---|---|
| | 0.8 | 1 | 1.5 | 2 | 2.3 | 2.5 | 2.8 | 3 | 6 | 7 | 8 | 9 | 10 | 12 | 15 | 20 |
| A1 | 14.4 | 14.1 | 13.3 | 12.6 | 12.2 | 11.9 | 11.5 | 11.1 | 6.7 | 5.2 | 3.7 | 2.5 | 2.4 | 2.2 | 2.1 | 1.7 |
| A2 | 16.0 | 15.7 | 15.0 | 14.2 | 13.9 | 13.5 | 13.1 | 12.7 | 8.3 | 6.8 | 5.3 | 3.9 | 3.3 | 2.3 | 2.1 | 1.9 |
| A3 | 17.3 | 17.0 | 16.2 | 15.5 | 15.1 | 14.7 | 14.4 | 14.0 | 9.6 | 8.1 | 6.6 | 5.1 | 3.6 | 2.5 | 2.3 | 2.0 |
| A4 | 18.3 | 18.0 | 17.2 | 16.5 | 16.1 | 15.8 | 15.4 | 15.0 | 10.6 | 9.1 | 7.6 | 6.1 | 4.7 | 2.7 | 2.5 | 2.2 |
| A5 | 19.1 | 18.8 | 18.1 | 17.4 | 17.0 | 16.6 | 16.3 | 15.9 | 11.4 | 10.0 | 8.5 | 7.0 | 5.5 | 3.0 | 2.8 | 2.3 |
| A6 | 19.9 | 19.6 | 18.9 | 18.1 | 17.7 | 17.4 | 17.0 | 16.6 | 12.2 | 10.7 | 9.2 | 7.8 | 6.3 | 3.3 | 3.0 | 2.5 |
| A7 | 20.6 | 20.3 | 19.5 | 18.8 | 18.4 | 18.0 | 17.7 | 17.3 | 12.9 | 11.4 | 9.9 | 8.4 | 6.9 | 4.0 | 3.3 | 3.0 |
| A8 | 21.1 | 20.9 | 20.1 | 19.4 | 19.0 | 18.6 | 18.3 | 17.9 | 13.5 | 12.0 | 10.5 | 9.0 | 7.5 | 4.6 | 3.7 | 2.7 |
| B8 | 32.8 | 32.5 | 31.8 | 31.1 | 30.7 | 30.3 | 29.9 | 29.6 | 25.1 | 23.7 | 22.2 | 20.7 | 19.2 | 16.3 | 11.8 | 4.4 |
| B7 | 34.1 | 33.8 | 33.0 | 32.3 | 31.9 | 31.6 | 31.2 | 30.8 | 26.4 | 24.9 | 23.4 | 21.9 | 20.5 | 17.5 | 13.1 | 5.7 |
| B6 | 35.1 | 34.8 | 34.1 | 33.3 | 33.0 | 32.6 | 32.2 | 31.9 | 27.4 | 25.9 | 24.5 | 23.0 | 21.5 | 18.5 | 14.1 | 6.7 |
| B5 | 36.7 | 36.4 | 35.7 | 34.9 | 34.6 | 34.2 | 33.8 | 33.5 | 29.0 | 27.5 | 26.1 | 24.6 | 23.1 | 20.1 | 15.7 | 8.3 |
| B4 | 38.0 | 37.7 | 36.9 | 36.2 | 35.8 | 35.5 | 35.1 | 34.7 | 30.3 | 28.8 | 27.3 | 25.8 | 24.4 | 21.4 | 17.0 | 9.6 |
| B3 | 39.0 | 38.7 | 38.0 | 37.2 | 36.9 | 36.5 | 36.1 | 35.7 | 31.3 | 29.8 | 28.3 | 26.9 | 25.4 | 22.4 | 18.0 | 10.6 |
| B2 | 39.9 | 39.6 | 38.8 | 38.1 | 37.7 | 37.4 | 37.0 | 36.6 | 32.2 | 30.7 | 29.2 | 27.7 | 26.3 | 23.3 | 18.9 | 11.5 |
| B1 | 40.6 | 40.3 | 39.6 | 38.8 | 38.5 | 38.1 | 37.7 | 37.4 | 32.9 | 31.4 | 30.0 | 28.5 | 27.0 | 24.0 | 19.6 | 12.2 |

The coating compound according to the invention can further include one or a plurality of fillers. The portion of the filler(s) is not considered in the calculation of the 100% by weight. In fact, the filler is added in addition to the 100% by weight.

In the context of the present invention, the weight portions of the substances in each case refer to the dry substances, and not to the substances in their commercially available form, in which they include a certain water content as moisture. The water content in each case refers to all of the water, that is, the added water plus the water, which is present/bound in the substances, for example the starch, as moisture. Unless otherwise specified, the information % by weight always refers to the proportion by weight per proportion by weight.

Viscosity and pH-value of the Coating Compounds

The lower limit of the viscosity of the ready-to-use or of the used coating compounds according to the invention, respectively, in mPas, measured at 40° C. using a Brookfield viscometer at a rotational speed of 100 rpm, is 50, preferably 70, more preferably 100, most preferably 150.

The upper limit of the viscosity in mPas is 5,000, preferably 3,000, more preferably 2,500, more preferably 2,200, more preferably 2,000, more preferably 1,800, more preferably 1,600, most preferably 1,500.

Most preferably, the viscosity of the coating compound is in the range of 200 to 1,000 mPas.

If the viscosity is too low, an application weight, which is too low, and thus a barrier coating or a barrier layer, respectively, which is too thin, is obtained when using starch-based coating compounds. If the viscosity is too high, an application weight, which is too high, is obtained, and/or a controlled, even application is impacted disproportionately when using starch-based coating compounds.

The pH-value of the coating compound according to the invention is preferably >4, preferably >5, preferably >6, more preferably >6.5, most preferably >6,7 and, on the other hand, is preferably <10, preferably <9, preferably <8.5.

Starch

With regard to the origin and the processing, any starches or any mixtures thereof can on principle be used as starch for the coating composition, coating compound and the coating. For example, they can be used in the native state as well as in the physically and/or chemically/enzymatically modified state.

With regard to the origin, root starches, such as, for example, potato starches or tapioca starches are preferred. Tapioca starch is particularly preferred. Tapioca starch is colorless and flavorless and genetically modified alternatives of tapioca starches are not known yet. Pea starch is further preferred, because it turned out that it has particularly good film-forming characteristics.

In a preferred embodiment, the starch is used in the native, that is, in the non-modified state. Usable characteristics can be obtained herewith at low costs.

In a further preferred embodiment, substituted starches, such as starch esters and starch ethers, are used, such as, for example, hydroxypropylated or acetylated starches. These modifications lead to a particularly high expansibility of the barrier coating or of the barrier layer, respectively, which is an important advantage in response to the creasing and folding of the barrier coating. In the alternative, oxidated starches are used. Hydroxypropylated starches are particularly preferred.

In a further preferred embodiment, cross-linked starches are used, in particular cross-linked starch esters or cross-linked starch ethers, respectively, for example starch phosphates and starch adipates. Preferably, the cross-linking is lightly pronounced. Such starches are commercially available. Improved mechanical characteristics are obtained by increasing the molecular weight, which is associated with the cross-linking. Cross-linked hydroxypropylated starches, in particular lightly cross-linked hydroxypropylated starches are particularly preferred. In terms of a simpler processing, non-cross-linked hydroxypropylated starches are preferred.

According to a further embodiment of the present invention, the starch is a non-cross-linked starch or a mixture of non-cross-linked starches.

In a preferred embodiment, substituted tapioca starch is used, in particular hydroxypropylated tapioca starch. Preferably, cross-linked substituted tapioca starch, such as, for example, hydroxypropylated starch phosphate.

In a further preferred embodiment, substituted pea starch is used, in particular hydroxypropylated pea starch. Preferably, cross-linked substituted pea starch, such as, for example, hydroxypropylated starch phosphate The amylose content of the starch(es) in % by weight is preferably <60, more preferably <50, more preferably <40, more preferably <37, more preferably <35. It turned out that high amylose contents can lead to a reduced expansibility of the barrier coating.

The amylose content of the starch(es) in % by weight is preferably >=0, more preferably >0.5, more preferably >0.7, more preferably >1, more preferably >2.5, most preferably >5. Amylose contents, which are too low, can lead to a reduced expansibility of the barrier coating.

According to preferred embodiments, so-called "waxy" starches are not used in the coatings and the coating compounds according to the invention.

Starches comprising a dextrose equivalent (DE) of <3, more preferably <1, most preferably <0.7, more preferably <0.5, more preferably <0.2, more preferably <0.1, most preferably <0.05 are further preferred. The dextrose equivalent of a polysaccharide mixture identifies the percentage of reducing sugars in the dry substance. It corresponds to the quantity of glucose (=dextrose), which would have the same reducing power per 100 g of dry substance. The DE value is a measure for the extent of the polymer degradation. In the case of high DE values, inferior mechanical characteristics are obtained. The dextrose equivalent is determined according to the ISO standard 5377.

According to preferred embodiments of the invention, starches are used, which are approved for applications for contact with food.

The starch in the coating compound is dissolved. In terms of the present patent application, a starch is considered to be dissolved, when at least 80%, preferably at least 90%, preferably at least 95%, preferably at least 97%, more preferably at least 99% of the starch granules are present in swollen state and are no longer birefringent when looking at it under the polarization microscope.

In the case of a dissolved starch, preferably at least 10%, more preferably more than 30%, more preferably more than 50%, more preferably more than 70% and more preferably more than 90% of these starch granules have burst and have already disintegrated into fragments.

More preferably, all starch granules have substantially disintegrated. More preferably, the dissolved starch is a genuine molecular solution, in which the starch granules are completely destructured, thus destroyed, and in which fragments of starch granules are also not present any longer. In the case of aqueous systems, the dissolved form of starch is typically obtained by means of the following measures: cooking the starch, in particular by means of a jet cooker, heating to a temperature of above the gelatinizing temperature, dissolving extruded, amorphous starch, using pre-gelatinized starch. In response to dissolution, the starch granules initially absorb water and gelatinize. Gelatinized starch granules degradade easily into fragments under shear and the fragments can then dissolve completely. The gelatinized starch granules also disintegrate into fragments as a result of cooking them for a longer period of time, and a genuine molecular solution is finally created. A molecular solution is obtained very quickly by means of the jet cooker. The destructuring degree of the starch granules can be determined and identified by means of a simple light microscopic examination, for example at a 200-times magnification. Preferably, the starch is stained with iodine.

Molecular Weight of the Starch

A large molecular weight $M_w$ of the starch is a prerequisite for providing for the required mechanical characteristics of the barrier coating. The at least one starch, which is used to formulate the coating composition, thus has a molecular weight $M_w$ in million g/mol of at least 0.8, preferably 1.0, more preferably 1.5, more preferably 2.0, more preferably 2.25, more preferably 2.5, more preferably 2.75, most preferably 3.0.

On principle, an upper limit for the at least one starch for formulating the coating composition does not exist. The reason for this is that the starch macromolecules are mechanically unstable in the case of very high molecular weights, such as, for example, in the case of >20 million g/mol. In the case of the common preparation methods, the compound is stirred when the starch is cooked, and the shear occurring thereby is already sufficient to tear apart the macromolecules, wherein a molecular weight $M_w$ of <20 million g/mol follows or can follow quickly, respectively. Typically, molecular weights $M_w$ of approximately 15 million g/mol or even 12 million g/mol result in response to the common stirring speeds.

Starches having an upper limit of the molecular weight $M_w$ in million g/mol of preferably 20, more preferably 15, more preferably 12, more preferably 10, more preferably 9, more preferably 8, more preferably 7, most preferably 6, are nonetheless used for the formulation of the coating composition according to a preferred embodiment. As the molecular weight decreases, the production of the coating compound becomes simpler, and lower viscosities are finally obtained.

Plasticizer

On principle, all of the plasticizers listed in the prior art for starch as well as any mixtures thereof are possible as plasticizer. Unless otherwise specified, the term plasticizer in the present patent application is to comprise a plasticizer as well as mixtures of plasticizers.

A small plasticizer content leads to a brittleness of the barrier layer in the case of low humidity, while a high plasticizer content leads to adhesives and to a soft material of little expansion in the case of high humidity.

Plasticizers can be used individually or in mixtures of different plasticizers. Preferably, polyols are used, such as, for example, glycerin, sorbitol, maltitol, erythritol, xylitol, mannitol, galactitol, tagatose, lactitol, maltulose, isomalt, maltol etc., but also various sugars, such as saccharose/sucrose, maltose, trehalose, lactose, lactulose, galactose, fructose etc., as well as mono- and oligosaccharides. Glycerin is particularly preferred as plasticizer. Water is also a plasticizer for starch, but is not counted as plasticizer here and will be considered separately.

The upper limit for the plasticizer content of the coating compound in % by weight, based on starch plus plasticizer, is 70, preferably 60, more preferably 55, more preferably 50, more preferably 46, most preferably 42.

In one embodiment, the lower limit for the plasticizer content of the coating compound in % by weight, based on starch plus plasticizer, is 0. According to further embodiments, the lower limit for the plasticizer content of the coating compound in by weight, based on starch plus plasticizer, is preferably 5, more preferably 10, more preferably 15, more preferably 20, more preferably 25, more preferably 28, more preferably 31, more preferably 32.5, most preferably 33.5.

The limits for the plasticizer content of the barrier layer correspond to the limits for the plasticizer content of the coating compound.

In preferred embodiments, plasticizers comprising a maximum melting temperature of 150° C. (for the anhydrous plasticizer), preferably 125° C., more preferably 110° C., more preferably 95° C., most preferably 70° C. are used. The portion of these plasticizers in the total plasticizer content in % by weight is >50, preferably >70, more preferably >80, most preferably >90. As the melting temperature of the plasticizer decreases, the plasticizing effect thereof increases.

In a preferred embodiment, plasticizers comprising a molar mass in g/mol of >90, preferably >120, preferably >140, preferably >150, most preferably >160 are used. The portion of the plasticizers, which fulfill this condition, in the total plasticizer content of the coating compound in % by weight is >10, preferably >20, more preferably >30, most preferably >40. As the molar mass of the plasticizer increases, the ability of the plasticizer to migrate decreases, the plasticizer thus then has a reduced tendency to migrate from the barrier coating into the substrate of the packaging material, for example the paper. The barrier coating loses flexibility as a result of the migration of the plasticizers.

In preferred embodiments, a combination of at least 2 plasticizers is used, preferably of at least 3 plasticizers, wherein at least 5%, preferably at least 10, most preferably at least 15% of the individual plasticizers are represented in the combination. 2 isomeric plasticizers are hereby considered to be different plasticizers. The tendency of the individual plasticizers to crystallize can be reduced by the combination of plasticizers. The plasticizing effect disappears in response to crystallization.

Modifying Polymers

In addition to the starch or starch mixture comprising a molecular weight $M_w$ of at least 800,000 g/mol, which is not counted here as belonging to the polymeric additives or modifying polymers, respectively, mentioned in this paragraph, at least one further polymeric additive can optionally be added to the coating compound, so as to modify the mechanical characteristics of the barrier coating or barrier layer, respectively, in an advantageous manner, in particular to increase the flexibility thereof, as well as to improve the processability of the coating compound. These modifying polymers furthermore contribute to an increase of the solids content.

On principle, all hydrophilic substances and mixtures thereof are possible as modifying polymers, in particular hydrophilic polymers and of those, preferably those from plant-based sources. Preferably, this polymer includes polar groups, such as, for example, hydroxyl groups, carboxyl groups or also ionic groups, such as carboxylate- or sulfonate groups.

Hydrocolloids and rubbers, such as galactomannan, such as guar rubber or locust bean gum; cellulose derivatives, in particular cellulose ether; pectins, in particular rhamnogalakturonanes and protopectins; dextrans; xanthan; zymosan; hydrocolloids of seaweed, such as alginates, agar-agar, agarose, carrageen and carrageenans; furcellaran; hydrocolloids of lichens, such as lichenins and isolichenins or hydrocolloids as exudates of woods, such as tragant (astragalus rubber), karaya rubber, rubber arabicum, kutira rubber; inulin; latex; chitin; chitosan; gellan; collagen; gelatin; casein; starch comprising a molecular weight $M_w$ of less than 800,000 g/mol as well as any combinations thereof are examples for modifying polymers.

In preferred embodiments, the maximum portion of modifying polymer or modifying polymers of the coating compound, as well as in the barrier coating, in % by weight, based on starch plus modifying polymer, is 50, more preferably 40, more preferably 30, more preferably 20, more preferably 10, more preferably 5, more preferably 2.5, most preferably 1.5.

If present, the minimum portion of modifying polymer or modifying polymers of the coating compound, as well as in the barrier coating, in % by weight, based on the starch plus modifying polymer, is 0.01, preferably 0.05, more preferably 0.1, more preferably 0.3, more preferably 0.6, more preferably 0.8, most preferably 1.0. Due to the fact that the modifying polymer represents an optional component, the minimum portion can also be 0% by weight.

According to preferred embodiments, xanthan is used as modifying polymer, because xanthan can also prevent the sedimentation of solids, which are suspended in the coating compound, such as fillers, for example, and, if applicable, remainders of starch granules in a particularly effective manner. A maximum portion of <2.5% by weight of xanthan as modifying polymer of the coating compound and of the barrier coating turned out to be particularly advantageous in further embodiments. The minimum portion of xanthan in % by weight is 0, preferably 0.01, more preferably 0.05, more preferably 0.1. Xanthan can in particular be used in combination with one or a plurality of any of the above-mentioned starches. In particular, any combination with the other components, thus plasticizers, polymeric additives, fillers, additives, lecithin and fatty acids are also comprised according to the invention.

In a further preferred embodiment, water-soluble cellulose derivatives are used, such as, for example, methylcellulose, ethylcellulose, hydroxyethylcellulose, carboxymethylcellulose, hydroxyethylmethylcellulose or hydroxypropylmethylcellulose.

Preferably, polyvinyl alcohol (PVA) is furthermore used, because PVA does not only stabilize the coating compound, but also improves the mechanical characteristics of the barrier coating, in particular the flexibility thereof. Preferably, PVA comprising a hydrolysis degree of >70%, more preferably of >75% more preferably >80%, most preferably >85% is used. A hydrolysis degree of <99%, more preferably of <98%, most preferably <96% is furthermore preferred. According to DIN 53015, a 4% solution of the PVA at 20° C. preferably has a viscosity in mPas of >3, preferably >5, more preferably >7, more preferably >10, most preferably >15.

In a preferred embodiment, the maximum portion of PVA in % by weight, based on starch plus PVA, is 40, more preferably 30, more preferably 20, more preferably 15, more preferably 10, more preferably 7, more preferably 5, particularly preferably 4. The minimum portion of PVA in % by weight is 0, preferably 0.1, more preferably 0.3, more preferably 0.6, more preferably 1, more preferably 1.5, more preferably 2, most preferably 3. PVA can in particular be used in combination with one or a plurality of any of the above-mentioned starches. In particular, any combination with the other components, thus plasticizers, polymeric additives, fillers, additives, lecithin and fatty acids are also comprised according to the invention.

The above-mentioned ranges for xanthan and PVA are to obviously be understood such that, if one component or both components is/are present, they form a portion of the modifying polymers or that the modifying polymer includes only xanthan and/or PVA. The value ranges for xanthan and PVA are thus not to be understood as additive to the above-mentioned general value ranges for the modifying polymer(s).

The limits for the portion of modifying polymer of the barrier coating correspond to the limits for the portion of modifying polymer in the coating compound.

Filler

All components, which are virtually insoluble in water or which are present in the coating compound as well as in the barrier coating in the form of particles, such as, for example, pigments, glass particles, soot particles, mineral particles, such as titanium dioxide, talc, carbonates, are identified as filler component of the coating compound or of the barrier coating, respectively. The filler component is mathematically deducted in the formulations, because it is not significant for most of the functional components of the formulation, whether or not a filler component is present. Unless otherwise specified and unless obvious otherwise, the % by weight information relating to the composition of the barrier coating in the embodiments below, which are cited as being particularly preferred, in each case refer to the portions without an optionally additionally comprised filler component.

Despite this, the portion of the filler component in % by weight in the case of the dry barrier layer, thus of the total compound of starch and optional components here, but without water, is <50, more preferably <30, more preferably <20, more preferably <10, more preferably <5, most preferably <3. The flexibility of the barrier coating is primarily reduced in the case of higher portions of filler.

If present, the minimum portion of the filer component in % by weight in the case of the dry barrier layer is 0.1, more preferably 0.2, more preferably 0.5, more preferably 0.8, particularly preferably 1.0. Due to the fact that the filler component represents an optional component, the minimum portion can also be 0% by weight.

The limits for the filler content of the barrier coating correspond to the limits for the filler content of the coating compound.

Additives

The coating compound according to the invention can further optionally comprise one or a plurality of additives. For example, the following additives can thus be used as further components of the coating compound: surface-active agents, such as, for example, ionic or non-ionic tensides, wetting agents, antifoam agents, stabilizers, dyes, further polymers in addition to those already mentioned, biozides, pH-regulators, thixotropic agents.

The portion of the additive or additives, respectively, based on the dry coating compound, is 0 to maximally 5% by weight. The portion is preferably <3, more preferably <2, more preferably <1, most preferably <0.7. If present, the minimum portion of the additive or additives, respectively, is preferably 0.1% by weight.

The limits for the additive content of the barrier coating correspond to the limits for the additive content of the coating compound.

Lecithin and Fatty Acids

The coating compound according to the invention and thus the barrier layer can further optionally include lecithin and/or fatty acids.

The lecithin is preferably soy lecithin. Lecithin reduces the water sensitivity of the barrier layer, in particular the ductility is increased in response to low humidity.

The lower limit of the lecithin portion in the coating compound or the barrier layer in % by weight, based on the starch, is 0, preferably 0.01, more preferably 0.05, more preferably 0.1. The upper limit of the lecithin portion in the coating compound or the barrier layer in % by weight, based on the starch, is 10, preferably 7, more preferably 5, more preferably 4, more preferably 3.

Edible fatty acids are preferred in the case of the fatty acids. Stearic acid is particularly preferred. Fatty acids reduce the water sensitivity of the barrier layer, in particular the adhesiveness is increased in the case of high humidity.

The lower limit of the fatty acid portion in the coating compound or the barrier layer in % by weight, based on the starch is 0, preferably 0.01, more preferably 0.05, more preferably 0.1. The upper limit of the fatty acid portion in the coating compound or the barrier layer in % by weight, based on the starch, is 10, preferably 7, more preferably 5, more preferably 4, more preferably 3.

Water Content and Solids Content of the Coating Compound

Water is important for adjusting the viscosity of the coating compound. The higher the water content of the coating compound, the lower the viscosity thereof. On the other hand, a high water content makes drying more difficult, because more water must then be removed from the barrier coating.

The portion of the water for the formulation of or in the coating compound is calculated from the difference of 100% by weight, minus the sum of the % by weight portions of all of the other components, except for the fillers.

The following compositions of the coating compound turned out to be particularly suitable for providing a barrier layer with regard to the mechanical characteristics and/or the barrier effect of the barrier layers obtained therefrom, as well as with regard to the processability of the coating compound:

Preferably, the starch is a hydroxypropylated pea starch comprising a molecular weight in million g/mol in the range of 1 to 20, preferably of 2.5 to 10. Preferably, the plasticizer is glycerin. The plasticizer content in % by weight, based on starch and plasticizer, is in the range of 0-45, preferably of 15 to 37, the starch content, based on starch and water and plasticizer, is in the range of 14 to 35% by weight. The coating compound preferably further comprises a portion of PVA of 1 to 30% by weight, preferably 1 to 20% by weight, more preferably 1 to 10% by weight.

Barriers, which are particularly well suited are obtained from these compositions, when the barrier layer is preferably applied in two passes, wherein a surface weight (dry) of 5 to 15 g/m$^2$ is preferably applied for each pass.

Comparable results are obtained, when a hydroxypropylated tapioca starch or a hydroxypropylated potato starch is used instead of the hydroxypropylated pea starch. The portion of the starch in the coating compound is determined as explained above according to Table 1. The above-mentioned preferred upper and lower limits also apply for the starch portion.

of 2.5 to 10. Preferably, the plasticizer is glycerin. The plasticizer content in % by weight, based on starch and plasticizer, is in the range of 0-45, preferably of 15 to 37, the starch content, based on starch and water and plasticizer, is in the range of 14 to 35% by weight. The coating compound preferably furthermore comprises a portion of PVA of 1 to 30% by weight, preferably 1 to 20% by weight, more preferably 1 to 10% by weight.

Particularly well suited barriers are also obtained from these compositions, when the barrier layer is preferably applied in two passes, wherein preferably a surface weight (dry) of 5 to 15 g/m$^2$ is applied for each pass.

In a further aspect, the present invention relates to the use of a starch-based coating composition or coating compound for surface-sealing of packaging materials, to prevent or to reduce the migration of lipophilic contaminants, such a mineral oil residues, in particular MOSH and/or MOAH contained in the packaging material.

The used coating compound comprises

- at least one starch comprising a molecular weight $M_w$ in the range of 800,000 to 20,000,000 g/mol,
- 0-70% by weight of plasticizer, wherein the plasticizer portion is based on starch plus plasticizer,
- 0-50% by weight of a polymeric additive or a plurality of polymeric additives, wherein the portion of the polymeric additive(s) is based on starch plus polymeric additive,
- 0-5% by weight of an additive or an additive mixture, based on the dry mixture, and water, wherein the at least one starch is present in dissolved form.

With regard to the plasticizer, the polymeric additives, the additives as well as the filler, which may also be present optionally, reference is made to the explanations above.

With regard to the origin of the starch as well as the molecular weight $M_w$ of the starch, reference is also made to the explanations above. It applies for the portion of the starch that in a preferred embodiment, the lower limit as well as the upper limit for the portion of the at least one starch in the coating compound in % by weight, based on starch, plasticizer and water, is provided in dependence on the molecular weight $M_w$ of the at least one starch by:

| | $M_w$ million g/mol | | | | | | | | | | | | | | | |
|---|---|---|---|---|---|---|---|---|---|---|---|---|---|---|---|---|
| | 0.8 | 1 | 1.5 | 2 | 2.3 | 2.5 | 2.8 | 3 | 6 | 7 | 8 | 9 | 10 | 12 | 15 | 20 |
| lower limit | 14.4 | 14.1 | 13.3 | 12.6 | 12.2 | 11.9 | 11.5 | 11.1 | 6.7 | 5.2 | 3.7 | 2.5 | 2.4 | 2.2 | 2.1 | 1.7 |
| upper limit | 40.6 | 40.3 | 39.6 | 38.8 | 38.5 | 38.1 | 37.7 | 37.4 | 32.9 | 31.4 | 30.0 | 28.5 | 27.0 | 24.0 | 19.6 | 12.2 |

According to a further preferred embodiment, the starch is a hydroxypropylated tapioca starch comprising a molecular weight in million g/mol in the range of 1 to 20, preferably from 2.5 to 10. Preferably, the plasticizer is glycerin. The plasticizer content in % by weight, based on starch and plasticizer, is in the range of 0-45, preferably of 15 to 37, the starch content, based on starch and water and plasticizer, is in the range of 14 to 35% by weight. The coating compound preferably furthermore comprises a portion of PVA of 1 to 30% by weight, preferably 1 to 20% by weight, more preferably 1 to 10% by weight.

According to a further preferred embodiment, the starch is a hydroxypropylated potato starch comprising a molecular weight in million g/mol in the range of 1 to 20, preferably and wherein the lower and upper limit for the portion of this starch in the case of molecular weights, which lie between the values of the Table, can be obtained by means of linear interpolation. Further preferred limits can be gathered from Table 1 as mentioned above. All of the coating compounds disclosed above represent particularly preferred embodiments for the use according to the invention.

Barrier Layer

The starch-based barrier layer according to the invention comprises

- at least one starch comprising a weight average of the molecular weight distribution $M_w$ in g/mol of 0.8 million up to 20 million, 0-70% by weight of plasticizer, wherein the plasticizer portion is based on starch plus plasticizer, 0-50% by weight of a polymeric additive or of a plurality of polymeric additives, wherein the portion of the polymeric additive(s) is based on starch plus polymeric additive.

0-5% by weight of an additive or an additive mixture, based on the dry mixture, and, optionally water, which is bound in the barrier layer.

The barrier layer according to the invention can further comprise fillers. The sum of all of the components included in the barrier layer, with the exception of the optionally included fillers, thereby results in 100% by weight. If present, the portion of filler is additionally added to the coating compound.

With regard to the plasticizer, the polymeric additives and the additives as well as the optionally also comprised filler reference is made to the explanations above.

With regard to the origin of the starch as well as the molecular weight $M_w$ of the starch, reference is also made to the explanations above.

Water Content of the Barrier Layer

A portion of the water of the coating compound can be bound in the solidified barrier layer. The remaining water is lost mainly when drying the packaging material. The maximum water content of the barrier layer in the finished packaging material directly after the production is maximally 25% by weight, preferably maximally 20% by weight, more preferably maximally 15% by weight, more preferably maximally 10% by weight, more preferably maximally 7% by weight, more preferably maximally 5% by weight, and most preferably maximally 3% by weight.

The finished, dried barrier layer is preferably solid and non-tacky.

Surface Weight

As the surface weight increases, the barrier effect of the barrier coating increases. The surface of papers, pasteboards and cardboard is not really smooth, but has a more or less pronounced roughness—a type of mountain and valley landscape. To obtain a good barrier effect, the valleys must initially be filled and the layer should then also still cover the highest mountain peaks. Due to the fact that rougher papers are also used in the packaging industry for price reasons, and due to the fact that a good barrier layer is to also be obtained in the case of these papers, it is necessary that thicker barrier coatings can be applied. A barrier effect, which is as good as possible, and rougher papers thus require a larger application quantity or a larger surface weight, respectively. However, the material and process costs are also increased with this, in particular because thick layers can only be obtained by repeatedly applying coating compounds, wherein the applied layer must be dried in-between in each case. In addition, the flexibility of the barrier coating is reduced as the thickness increases.

The upper limit for the surface weight (dry compound) of the barrier in $g/m^2$ is thus preferably 80, preferably 70, more preferably 60, more preferably 55, more preferably 50, more preferably 45, more preferably 40, more preferably 35, more preferably 30, most preferably 25.

On the other hand, the lower limit for the surface weight of the barrier in $g/m^2$ is 3, preferably 5, more preferably 7, more preferably 9, most preferably 10.

The upper limit for the surface weight (dry compound) in $g/m^2$ for an individual application is preferably 30, preferably 25, more preferably 20, more preferably 18, more preferably 17, more preferably 16, more preferably 15, most preferably 14. The thinner the application, the less blister formation and pinholes can be expected and the easier the application compound can be dried.

The lower limit for the surface weight (dry compound) in $g/m^2$ for an individual application is preferably 3, preferably 4, more preferably 5, more preferably 6, more preferably 7. The thicker the application, the better the coverage of the paper and the more effective the barrier.

Surprisingly, it turned out that the barrier layers according to the invention are flexible or remain flexible, respectively, even on the packaging material. This is surprising, because an inherently flexible starch film, when it is applied to a paper, can often very clearly lose flexibility. If, for example, a starch-based casting compound is cast onto a Teflon film and is dried, a soft and flexible film can be obtained. However, if the same casting compound is applied to a paper, a hard, inflexible film can result, which already forms tears even without mechanical stress. Due to the fact that, for the most part, starch films require a portion of plasticizer so as to be soft and flexible and not brittle, one might assume that the film on the paper loses plasticizer to the paper and that this is the reason for the brittleness of an inherently flexible starch film. On the other hand, the mentioned brittleness was not always observed. Surprisingly, it turned out that the flexibility increases considerably as the molecular weight increases, starting at approximately 800,000g/mol. In the world of macromolecules, this is already a very high molecular weight and one might have expected that the flexibility is more likely to decrease than increase in the case of such high molecular weight, because the entanglement of the macromolecules increases with the molecular weight, whereby it is made more difficult for the macromolecules to slide past one another. The flexibility of the starch film on the paper further increased as the molecular weight increased.

The barrier layers obtained according to the invention are furthermore characterized in that they cover the entire surface and do not have any surface defects, for example in the form of pinholes. Pinholes or blisters are typically created when the applied coating compound dries. After the coating compound was applied to the paper, a part of the coating compound is absorbed by the nearest paper layers. In response to the drying, the coated paper side is treated with infrared radiation and/or hot air. The surface of the coating thereby dries quicker than the layers located therebelow, wherein a barrier against the steam, which wants to escape from the lower layers, is formed in the region of the surface. This leads to the formation of steam bubbles, which finally burst and which lead to surface defects in the barrier layer. The thicker the layer, the more difficult it is to prevent such blisters. The part of the coating compound, which was absorbed by the paper and which has penetrated more or less deeply into the paper, is particularly problematic. Even in the case of very slow and thus uneconomical drying, blisters and pinholes can then still be created. Surprisingly, it turned out that the tendency to form blisters and pinholes decreases as the molecular weight increases. This behavior is attributed to the fact that the viscosity increases in response to low shear with the molecular weight as the molecular weight increases and a corresponding casting compound can thus penetrate the porous paper less well.

Packaging Material

The packaging material according to the invention has several layers and comprises a planar substrate as carrier layer and at least one barrier layer, which is applied to the planar substrate, and which is composed and structured as explained above.

Substrate

The barrier coating is applied to a planar substrate, which is suitable as packaging material. Preferably, the planar substrate is a paper, a pasteboard or a cardboard. Unless mentioned otherwise, the term paper in terms of the present patent application is to always also comprise pasteboard and cardboard. Papers, which can be used as substrate for the barrier coating, have a surface weight in $g/m^2$ of preferably <800, more preferably <600, more preferably <500, more preferably <400, most preferably <380. On the other hand, the surface weight thereof in $g/m^2$ is preferably >30, more preferably >50, more preferably >70, more preferably >90, more preferably >110, most preferably >120. In summary, paper is understood to be paper in a narrower sense, as well as cardboard and pasteboard.

More preferably, papers, which meet food regulations and which can thus be used as food packaging are used as substrate for the packaging material or as carrier material for the barrier coating, respectively.

The barrier coating is applied to the rear side of the substrate, thus to the side, which forms the inside of the packaging in the case of the finished packaging. This follows from the fact that a barrier is to be obtained against the interior of the packaging or the packaged good present therein, respectively. The rear sides of papers, which are suitable for packaging, are typically rough, while the front sides, which are mostly provided for printing, are comparatively smooth. However, papers comprising rather smooth rear sides are preferably used, because smooth surfaces can be refined significantly more easily with good barrier coatings. A smoother rear side can be obtained, for example, by means of a precoat. The precoat refers to a layer, which is applied to the paper substrate before the barrier layer. The precoat can already be applied at the paper manufacturer.

On the front side of the substrate, thus on the outside of the finished packaging, the packaging materials according to the invention can have further coatings, which are known to the person of skill in the art, or can be printed. In any event, the barrier layer does not form the outside of the finished packaging, but is arranged in such a manner that it established a border between the planar substrate, thus the carrier material, and the interior of the packaging and thus the packaged good contained in the packaging. If desired, the packaging material according to the invention can comprise further layers.

According to a further aspect, the present invention also relates to packaging, in particular folding packaging, which comprise the packaging material according to the invention or which can be made therefrom, respectively. The starch-based barrier layer does not form the outside of the packaging hereby.

Barrier Layer Applied to the Substrate

The applied barrier layer consists of at least one layer. The barrier layer is thus produced or applied, respectively, in at least 1 application (pass, coat). According to a preferred embodiment of the present invention, 2 applications are made, wherein the application compound is dried in-between. 3 and more applications are also possible, wherein 2 applications are preferred and 3 applications are more preferable than 4 applications.

Method

The method according to the invention for producing the multi-layer packaging material comprises the following steps:

a) providing a planar substrate, which preferably comprises a material chosen from the group consisting of paper, pasteboard and cardboard,
b) providing the coating compound according to the invention
c) applying the coating compound of step b) to at least one side of the planar substrate and forming a layer on the planar substrate, and
d) increasing the temperature for drying and solidifying the applied coating compound, which has been shaped to form a layer.

The coating compound according to the invention can be provided in that the starch, which is present in the form of powder, is mixed into a liquid phase, wherein the liquid phase has at least water, preferably has at least water and plasticizer. The suspension created thereby is then heated or "cooked", respectively, to a temperature above the gelatinizing temperature. The suspension can be cooked, for example at atmospheric conditions, that is, at a temperature of <100° C., or it is cooked by means of a jet cooker at temperatures of >100° C., for example at 130° C.

If applicable, precooked starch, such as, for example, pregelatinized starch is possibly also used instead of cooking starch, that is, starch, which must be cooked. Due to the fact, however, that a starch kitchen is typically present as standard in the paper industry, it is more advantageous to use the more cost-efficient cooking starch.

When cooking, the starch granules absorb water and the partially crystalline structure of the starch granule is converted into an amorphous, highly swollen structure, wherein the starch granule can absorb a multiple of the dead weight of water, but is initially still present as suspended particle. Once the starch granule has swollen maximally, the highest viscosity results. The higher the temperature, at which the starch is cooked, the longer the cooking process lasts, and the more intensive the mixture is sheared, for example by means of a mixer, the more the swollen starch granule disintegrate. Initially, it disintegrates into fragments, which, in turn, disintegrates into smaller fragments, until a genuine molecular solution has finally been created. During this transition from maximally swollen starch granule to the molecular solution, the viscosity is reduced considerably, without the molecular weight having to decrease thereby. Due to the fact that viscosities, which are as low as possible, are pursued, it is advantageous, if the starch is cooked until a molecular solution has been created more or less, which is typically the case when cooking with the jet cooker and when using shear. If precooked starch is used, the cooking process can be foregone, but it is advantageous to shear the mixture mechanically, for example by means of intensive stirring, so as to degradade the starch granules and to obtain a genuine solution of the starch macromolecules, if possible.

In response to cooking as well as in response to the subsequent cool-down phase and, if applicable, storage time, it is important to ensure that the pH lies in a range, where no chemical degradation of the starch occurs, which is the case, for instance, in the case of a pH-value of >4, preferably >5, more preferably >6, more preferably >6.5. Ideally, the pH-value is in the range of 7.

The starch compound prepared in this manner can then be applied to the paper with the desired surface weight by means of the methods, which are known in the paper industry. While typical coating compounds are applied to the front side of the paper in the paper industry, the coating compound, however, is applied to the rear side of the paper for a barrier layer.

Application of the Coating Compound

Methods for applying liquids to planar substrates are generally known. The coating can take place in different ways: e.g., the barrier compound can be coated, printed, cast, sprayed, rolled or applied in a planar and even manner in a different way. The layer thickness required for forming an effective barrier can thereby be applied in one or a plurality of passes.

In a preferred embodiment, the barrier compound is applied by coating or casting. Known and suitable coating methods are the blade coating, doctor coating and size press.

A particularly suitable casting method is the curtain coating, wherein particularly good barrier coatings can be obtained here with comparatively small application quantities.

Preferably, the barrier coating is produced in more than one coat. More preferably, the coating is produced in 2 coating passes, between which the substrate web does not necessarily need to be rolled up again. Surprisingly, a better barrier is obtained, when a barrier layer of a certain surface weight of, e.g., 20 g/m$^2$ is applied in 2 passes, wherein, e.g., 10 g/m$^2$ are applied in each case instead of in one pass, in which 20 g/m$^2$ are applied.

In the case of a smooth paper, a sufficient barrier coating can be obtained in 1 or 2 coating passes. In the case of a rough paper, 2 to 4 coating passes might be necessary.

In a preferred embodiment, a first barrier layer or a first application for the barrier layer, respectively, is obtained in-line with a paper machine. That is, the first application is obtained directly following the production of the paper on the fresh paper as rear side coating, without the paper web having been rolled up first. The second application is then carried out at a different location, after the paper web comprising the first application has been rolled up.

In a preferred embodiment, a precoat, which, on the one hand, serves the purpose of preventing the water from the coating compound of the following barrier layers from penetrating into the paper, the pasteboard or the cardboard, and, on the other hand, to smooth the surface, which is to be coated can be applied to the paper, the pasteboard or the cardboard, or can have been applied ahead of time, for example by the paper manufacturer. In particular in the case of paper, which is highly absorbent, such a precoat offers significant advantages. Preferably, the precoat also has characteristics, which reduce the migration of aliphatic and aromatic hydrocarbons.

In the case of a precoat, compounds can be applied, which are used in the paper industry to improve the surfaces, in particular to reduce the surface roughness, to improve the printability and the machine operation. A mineral precoat, for example a carbonate precoat, can thus be used. On the other hand, a starch-based compound can also be applied in the case of a precoat. A starch-based precoat differs from the barrier layer according to the invention in that the precoat does not have all of the features of the barrier layer according to the invention, it thus has starch comprising a different molecular weight distribution and/or a different portion than is specified in Table 1, for example.

The preferred weight average of the molecular weight distribution $M_w$ of the starch used in the precoat in g/mol is >500,000, preferably >1,000,000, preferably >2,000,000, preferably >2,500,000, particularly preferably >3,000,000, most preferably >4,000,000.

The above statements in the paragraphs "solids content of the coating compound" and "plasticizer" also apply with regard to solids content and plasticizer portion of the precoat compound from dissolved starch.

The upper limit for the surface weight of the precoat in g/m$^2$ is 30, preferably 25, more preferably 20, most preferably 15.

The lower limit for the surface weight of the precoat is 1, preferably 2, more preferably 3 and most preferably 5 g/m$^2$.

One or a plurality, preferably 2, 3 or 4 layers of the coating compound according to the invention can then be applied to the precoat as explained in detail above.

Speed

In the case of heavier papers, as they are preferably used as substrate for the barrier coating, the speed, with which the paper web, which is to be coated, is moved at the paper manufacturer, is roughly 100-1,000 m/min, which corresponds to a speed of 1.7 to 17 m/s. Most of the methods lie in the range of 200-800 m/min. In response to the further processing of papers, such as, for example, in the case of a coater, slower speeds are also used in parts. The barrier coating according to the invention can be produced in a continuous process at the speeds, which are standard in the industry.

Temperature of the Coating Compound

It is advantageous, when the coating compound is applied to the paper at an increased temperature.

In a preferred embodiment, the temperature in ° C. of the coating compound in response to application to the paper is >20, more preferably >30, more preferably >35, more preferably >40, most preferably >45.

For example, the upper limit of the application temperature depends on the composition of the coating compound, but clearly follows for the person of skill in the art from the above-mentioned demands on the viscosity and thus the coatability of the coating compound, among others.

Pretreatment of the Paper

An advantageous effect can be obtained, when the coating compound is applied to a preheated paper, wherein the paper can be heated by means of infrared heaters, for example. The heat from the paper can then also be used to heat up the applied coating compound.

In a preferred embodiment, the paper is thus heated, so that the side facing the coating has a temperature in ° C. of >30, more preferably >40, more preferably >50, more preferably >60, more preferably >70, most preferably >80 immediately prior to applying the coating.

Drying the Paper

The paper, which is coated with the coating compound, can be dried by means of the drying methods, which are common in the paper industry. Mainly infrared (IR) heaters and hot air hoods are used thereby. It is common thereby for that side of the paper to be treated with IR or hot air, on which a layer, which is to be dried, has been applied. In a preferred embodiment, however, at least a part of the drying method is carried out in such a manner that the other side of the paper (to which no layer, which is to be dried, has been applied) is treated with IR or hot air.

In a further preferred embodiment, both sides are simultaneously treated with IR or hot air in response to at least a part of the drying process.

The advantage of these preferred methods is that the formation of blisters and pinholes can be suppressed more easily and that better barriers can thus be obtained.

A generally common device for coating, in particular paper and cardboard, as it corresponds to the prior art, is illustrated schematically in FIG. 1. Significant components of such a device for coating a web 2 are the coating aggregate 4 and the adjacent drying device, on principle consisting of an IR radiant heater 8 and a hot air drying system 9. The web is thereby guided by so-called guide rollers 3. The web can be unrolled from a roller 1 and can be rolled up onto such a roller 1' again after drying.

However, this is not absolutely necessary: the coating can also represent an intermediate step, for example, in a multi-step continuous process.

The coating compound can be applied to the substrate surface, e.g., by means of applying with a doctor, blade coating, casting, rolling, spraying, printing or other methods, which are suitable to apply liquid compounds. A common embodiment of a coating aggregate 4 is illustrated in an exemplary manner in FIG. 1. The coating compound is applied to the paper via an application roller 5, which runs through a so-called coating sump 6. The excess coating compound is wiped off by means of a doctor or a blade 7. The coated web 2' is guided across the dryer 8, 9 and is thereby dried in such a manner that it can be formed into a paper roll 1' again in a roll-up device, without sticking thereby.

The drying methods, such as, for example, those based on infrared radiation and hot air or drying by means of hot rollers, which are known in the paper industry, are suitable for drying the coated paper web.

BRIEF DESCRIPTION OF THE FIGURE

FIG. 1 shows, schematically, a coating system according to the prior art, as it is common in the finishing of paper.

ANALYTIC METHODS

Determining the Application Weight

A paper having a known surface is dried in a circulating air oven at 130° C. for 15 min and is then weighed. The surface weight of the untreated paper can be obtained in g/m$^2$ from the weight and the known surface.

A coated paper having a known surface is dried in the same manner and is weighed and the surface weight of the coated paper is thus obtained in g/m$^2$. The surface weight of the coating is obtained in g/m$^2$ from the difference of the two surface weights.

Determining the Molecular Weight $M_w$ $M_w$ is understood to be the weight average of the molecular weight distribution.

If the starch is present in the form of powder, the starch is suspended in water with a concentration of 3% of dry substance. This suspension is then heated up in a mini autoclave to 150° C. by being stirred and is held there for 20 min. The solution obtained in this manner is then cooled down to approximately 60° C., is thinned to 0.3%, and is filtered with a 0.005 mm membrane filter. The filtered solution is then measured with GPC-MALLS (gel permeations chromatography with multi-angle laser light scattering).

If the starch is to be analyzed with regard to its molecular weight in a barrier layer on a paper, the following 2 methods can be used to obtain the starch solution.

1) The starch is scraped off the paper by means of a scalpel or it is abraded using a fine abrasive paper. The powdery material obtained thereby can be transferred into a solution, as is present for the above-described starch, which is present in the form of powder, in the same manner.

2) In the alternative, the barrier layer can be analyzed together with the paper. For this purpose, the material is cut into pieces of approx. 2*2 mm, is suspended in the autoclave and is stirred at room temperature overnight. The same process as described above for starches in the form of powder is then carried out. In response to the filtration, however, a coarse filter is used first, so as to filter out the insoluble paper components. Due to the fact that common papers can already include starch even without a barrier layer, a reference measurement is made, if necessary, with the uncoated paper or a reference measurement is made with the paper, from which the barrier layer was removed mechanically, respectively. An assessment can then be made from the reference measurement, which components are to be attributed to the barrier and which components are to be attributed to the paper during the GPC-MALLS analysis.

An Alliance 2695 separation module from Waters, a DRI detector 2414 from Waters, a MALLS detector Dawn-HELEOS from Wyatt Technologie comprising a wavelength of 658 nm and a K5 flow-through cell were used for the measurements. A SUPREMA gel column set was used for the GPC column, exclusion limits S30000 with 10E8-10E6, S1000 with 2E6-5E4, S100 with 1E5-1E3. Eluent: DMSO with 0.09 m $NaNO_3$. Temperature: 70° C. Evaluation: Astra software 5.5.0.18. A refractive index increment do/dc of 0.068 was used for the calculation.

MODES FOR CARRYING OUT THE INVENTION

EXAMPLE 1

Starch: Hydroxypropylated pea starch comprising $M_w$=4,500,000 g/mol

Formulation: (unless specified otherwise, all quantities refer to the total formulation)

18.0% by weight of starch dry 10.2% by weight of glycerin, corresponds to 36.17% by weight of glycerin, based on starch and glycerin, and 71.8% by weight of water 100% by weight total The mixture was cooked in a batch cooker comprising an anchor stirrer at 95° C. for approximately 45 min, so that a clear, homogenous solution comprising a solids content of 28.2% was created. This solution had a viscosity of 370 mPas at 50° C.

Paper: 230 g/m$^2$, without rear side coating

Coating aggregate: combo blade comprising flat doctor 20mm (0.8 bar contact pressure)

Web speed: 350 m/min

Application weight dry: 9.6 g/m$^2$

Drying setting: IR heater (65%), dry air: 160° C. (12 m drying section)

Quick test with spray oil showed a significant reduction of the permeability for hydrocarbons.

EXAMPLE 2

Starch: hydroxypropylated pea starch comprising $M_w$=4,500,000 g/mol

Formulation: (unless specified otherwise, all quantities refer to the total formulation)

17.8% by weight of starch dry 1.9% by weight of PVA (88% hydrolyzed, dynamic viscosity of 8 mPas at a 4% solution and 20° C.)

7.3% by weight of glycerin, corresponds to 29.0% by weight of glycerin, based on starch and glycerin, and 72.8% by weight of water 99.8% by weight total The mixture was cooked in a batch cooker comprising an anchor stirrer at 95° C. for approximately 45 min, so that a clear, homogenous solution comprising a solids content of 27.0% was created. This solution had a viscosity of 260 mPas at 50° C. 0.2% by weight of a commercially available wetting agent was added to the mixture, so as to obtain a stable curtain in response to the curtain coating.

Paper: 230 g/m$^2$, comprising a coating according to example 1

Coating aggregate: curtain coater

Web speed: 100 m/min

Application weight dry: 11 g/m$^2$

Drying setting: IR heater (65%), dry air: 160° C. (12 m drying section)

A measurement of the mineral oil migration from the cardboard through the coating was carried out in the style of method DIN14338 (so-called "Tenax method") and resulted in a barrier effect of 99.1% for MOSH and MOAH. After creasing and folding the paper, a barrier effect of 98.2% was obtained.

EXAMPLE 3

Starch: hydroxypropylated pea starch comprising $M_w$=20,960,000 g/mol

Formulation: (unless specified otherwise, all quantities refer to the total formulation)

8.6% by weight of starch dry 0.2% by weight of PVA (98% hydrolyzed, dynamic viscosity of 40 mPas with a 4% solution and 20° C.)

4.6% by weight of glycerin, corresponds to 34.84% by weight of glycerin, based on starch and glycerin, and 86.6% by weight of water 100% by weight total The mixture was cooked in a batch cooker comprising an anchor stirrer at 95° C. for approximately 45 min, so that a clear, homogenous solution comprising solids content of 13.4% was created. The solution had a viscosity of 600 mPas at 40° C.

Paper: commercially available folding box cardboard comprising 329 g/m$^2$, comprising a coating according to example 1

Coating aggregate: roll doctor C50, 1 bar contact pressure

Web speed: 200 m/min

Application weight dry: 8 g/m$^2$

Drying setting: IR heater (80%), dry air: 260° C. (12 m drying section)

Quick test with spray oil showed a significant reduction of the permeability for hydrocarbons.

EXAMPLE 4

Starch: hydroxypropylated pea starch comprising $M_w$=20,960,000 g/mol

Formulation: (unless specified otherwise, all quantities refer to the total formulation)

7.2% by weight of starch dry 0.2% by weight of PVA (98% hydrolyzed, dynamic viscosity of 40 mPas with a 4% solution and 20° C.)

3.9% by weight of glycerin, corresponds to 35.14% by weight of glycerin, based on starch and glycerin, and 88.5% by weight of water 99.8% by weight total The mixture was cooked in a batch cooker comprising an anchor stirrer at 95° C. for approximately 45 min, so that a clear, homogenous solution comprising solids content of 11.3% by weight was created. This solution had a viscosity of 320 mPas at 37° C. 0.2% by weight of a commercially available wetting agent was added to the mixture.

Paper: the coated paper from example 3

Coating aggregate: curtain coater

Web speed: 100 m/min

Application weight dry: 11.7 g/m$^2$

Drying setting: IR heater (60%), dry air: 250° C. (12 m drying section)

The migration measurement for MOSH/MOAH resulted in a barrier effect of 97.4%. After creasing and folding, a barrier effect of 96.0% was obtained.

EXAMPLE 5

Starch: hydroxypropylated pea starch comprising $M_w$=170,000 g/mol

Formulation: (unless specified otherwise, all quantities refer to the total formulation)

29.6% by weight of starch 10.8% by weight of glycerin, corresponds to 26.8% by weight of glycerin, based on starch and glycerin, and 59.6% by weight of water 100% by weight total The mixture was cooked in a batch cooker comprising an anchor stirrer at 95° C. for approximately 45 min, so that a clear, homogenous solution comprising a solids content of 40.4% was created. This solution had a viscosity of 1080 mPas at 43° C.

Paper: raw cardboard comprising 250 g/m$^2$

Coating aggregate: roll doctor (20 mm smooth, contact pressure 0.8 bar)

Web speed: 250 m/min

Application weight dry: 12.8 g/m$^2$

Drying setting: IR heater (60%), dry air: 150° C. (12 m drying section)

A second coating with the same starch solution was applied to the obtained coating (by adding 0.2% of wetting agent):

Coating aggregate: curtain coater

Web speed: 200 m/min

Application weight dry: 8.6 g/m$^2$

Drying setting: IR heater (30%), dry air: 160° C. (8 m drying section)

Migration measurements for MOSH/MOAH determined a barrier effect of just under 30%. SEM picture of the coating showed numerous tears comprising a width of a few micrometers.

LIST OF REFERENCE NUMERALS

1 raw paper roll
1' coated paper roll
2 raw paper web
2' paper web (coated)
3 guide rollers
4 coating device
5 application roller
6 coating sump
7 doctor
8 dryer
9 hot air dryer
10 paper web
11 application aggregate/blade coater
12 roll doctor
13 spraying device
14 steam shower
15 IR dryer

The invention claimed is:

1. A multi-layer packaging material, comprising:

a planar substrate selected from the group consisting of paper, pasteboard and cardboard as carrier layer, and at least one starch-based barrier layer, which is applied to the planar substrate, wherein the barrier layer comprises:

at least one starch comprising a weight average of the molecular distribution $M_w$ in the range of 0.8 million to 50 million g/mol, 0-70% by weight of at least one plasticizer, wherein the plasticizer portion is based on starch plus plasticizer, 0-50% by weight of at least one polymeric additive, wherein the portion of the polymeric additive(s) is based on starch plus polymeric additive, 0-5% by weight of an additive or of an additive mixture, based on the dry mixture, and, optionally, water bound in the barrier layer.

2. The packaging material according to claim 1, wherein the barrier layer is obtained from a coating compound comprised of:

the at least one starch, 0-70% by weight of the at least one plasticizer, wherein the plasticizer portion is based on starch plus plasticizer, 0-50% by weight of the at least one polymeric additive, wherein the portion of the polymeric additive(s) is based on starch plus polymeric additive, 0-5% by weight of the additive or of the additive mixture, based on the dry mixture, and water, wherein the at least one starch of the coating compound is present in dissolved form and has a weight average of the molecular weight distribution $M_w$ in g/mol in the range of 0.8 million to 50 million, and the lower limit as well as the upper limit for the portion of the at least one starch in the coating compound in % by weight, based on starch and plasticizer and water, is provided in dependence on the molecular weight $M_w$ of the starch by:

| | $M_w$ million g/mol | | | | | | | | | | | | | | | |
|---|---|---|---|---|---|---|---|---|---|---|---|---|---|---|---|---|
| | 0.8 | 1 | 1.5 | 2 | 2.3 | 2.5 | 2.8 | 3 | 6 | 7 | 8 | 9 | 10 | 12 | 15 | 20 |
| lower limit | 14.4 | 14.1 | 13.3 | 12.6 | 12.2 | 11.9 | 11.5 | 11.1 | 6.7 | 5.2 | 3.7 | 2.5 | 2.4 | 2.2 | 2.1 | 1.7 |
| upper limit | 40.6 | 40.3 | 39.6 | 38.8 | 38.5 | 38.1 | 37.7 | 37.4 | 32.9 | 31.4 | 30.0 | 28.5 | 27.0 | 24.0 | 19.6 | 12.2 |

wherein the lower and upper limits for the portion of the at least one starch comprising a weight average of the molecular weight distribution $M_w$, which lie between the values or outside of the values of the above Table, are obtained by means of linear interpolation or by means of linear extrapolation.

3. The packaging material according to claim 2, wherein the at least one starch in the coating compound comprises tapioca starch, pea starch, potato starch or any mixture thereof.

4. The packaging material according to claim 2, wherein an amylose content of the at least one starch in the coating compound is in the range of 0 to less than 60% by weight.

5. The packaging material according to claim 2, wherein the coating compound comprises at least 5% by weight of the at least one plasticizer.

6. The packaging material according to claim 2, wherein the at least one plasticizer of the coating compound comprises a plurality of plasticizers, wherein at least 5% of each one of the plurality of plasticizers are represented in the combination.

7. The packaging material according to claim 2, wherein the coating compound comprises maximally 30% by weight of the at least one polymeric additive.

8. The packaging material according to claim 2, wherein the at least one polymeric additive of the barrier layer comprises xanthan and/or polyvinyl alcohol.

9. The packaging material according to claim 2, wherein the at least one starch of the coating compound is selected from the group consisting of tapioca starch, pea starch and potato starch, and the starch is a hydroxypropylated starch comprising a molecular weight in million g/mol of 1 to 20 wherein the plasticizer content of the coating compound in % by weight, based on starch and plasticizer, is in the range of 0-45%, and the starch content of the coating compound in % by weight, based on starch and water and plasticizer, is in the range of 14 to 35%.

10. The packaging material according to claim 1, wherein the barrier layer is applied to an outer surface of the planar substrate, which corresponds to the rear side of the packaging material and thus to the inside of a packaging, which is to be created.

11. The packaging material according to claim 1, wherein the planar substrate additionally comprises a precoat which is arranged between the substrate surface and the barrier layer.

12. A packaging comprising the multi-layer packaging material according to claim 1, wherein the barrier layer forms the inside of the packaging.

13. The packaging material according to claim 1, where the at least one starch comprising a weight average of the molecular distribution $M_w$ in the range of 0.8 million to 20 million g/mol.

14. The packaging material according to claim 11, wherein the precoat is a mineral precoat.

15. The packaging material according to claim 8, further comprising 0.01 to less than 2.5% by weight of the xanthan and/or 1 to 30% by weight of the polyvinyl alcohol.

16. The packaging material according to claim 15, further comprising 1 to 10% by weight of the polyvinyl alcohol.

17. The packaging material according to claim 1, wherein the barrier layer further comprises polyvinyl alcohol in % by weight, based on starch and polyvinyl alcohol, present in the range of 1 to 30.

18. The packaging according to claim 12, comprising further layers in addition to the barrier layer.

* * * * *